US006871905B2

(12) United States Patent
Grace

(10) Patent No.: US 6,871,905 B2
(45) Date of Patent: Mar. 29, 2005

(54) PORTABLE COLLAPSIBLE SEAT

(76) Inventor: Daniel R. Grace, 8 Old Colony Rd., Old Saybrook, CT (US) 06475

( * ) Notice: Subject to any disclaimer, the term of this patent is extended or adjusted under 35 U.S.C. 154(b) by 0 days.

(21) Appl. No.: 10/345,518

(22) Filed: Jan. 16, 2003

(65) Prior Publication Data

US 2004/0140696 A1 Jul. 22, 2004

(51) Int. Cl.[7] ..... A47C 4/28
(52) U.S. Cl. ..... 297/16.2; 297/440.24; 297/188.08
(58) Field of Search ..... 297/16.2, 45, 440.24, 297/188.08

(56) References Cited

U.S. PATENT DOCUMENTS 615,476 A * 12/1898 Chapman ..... 108/118
1,921,984 A * 8/1933 Moore ..... 5/636
1,969,313 A 8/1934 Meeker
2,197,343 A * 4/1940 Marx ..... 5/640
D259,306 S 5/1981 Licastro, II
4,544,203 A * 10/1985 Younger et al. ..... 297/391
D282,320 S 1/1986 Anderson
4,934,638 A 6/1990 Davis
5,063,701 A * 11/1991 Ottens ..... 43/21.2
5,709,428 A * 1/1998 Hugghins ..... 297/16.2
5,752,537 A * 5/1998 Kranzler ..... 135/128
5,851,052 A * 12/1998 Gustafsson ..... 297/16.2
6,634,704 B1 * 10/2003 Bergquist ..... 297/16.2

* cited by examiner

*Primary Examiner*—Peter M. Cuomo
*Assistant Examiner*—Joseph Edell
(74) *Attorney, Agent, or Firm*—McCormick, Paulding & Huber LLP

(57) ABSTRACT

A portable collapsible stool has at least three legs including separable upper and lower parts releasably connected by telescopic joint connections biased into connected engagement by bungee cords. A flexible seat mounted on the upper ends of the legs is disposed in a horizontal seating position when the stool is in setup position. A panel assembly connected to the legs in upwardly spaced relation to the lower ends thereof extends therebetween, provides lateral reinforcement for the legs to increase the carrying capacity of the stool, serves as a ground-engaging member to increase the area of stool ground support when it is setup on soft or sandy ground penetrated by the legs, provides a handle to facilitate rapid simultaneous separation of the leg lower parts from the leg upper part, and may also include a pocket for small articles.

23 Claims, 5 Drawing Sheets

PORTABLE COLLAPSIBLE SEAT

FIELD OF THE INVENTION

This invention relates in general to stools and seats and deal more particularly with stools and seats of portable, collapsible type.

BACKGROUND OF THE INVENTION

Lightweight, portable, collapsible stools and seats of a type with which the present invention in concerned are enjoying increasing popularity for use in viewing sports activities, fireworks displays, air shows and in a wide variety of other outdoor activities such as camping, hunting, fishing and the like. However, such seats and stools as heretofore available provide somewhat limited load carrying capacity and may not offer the degree or security desired by a person of larger stature. Further, in some outdoor activities where lightweight portable seating may be desired, as for example, woodland activities, such as camping, hunting and fishing, less than ideal ground support conditions are often encountered. Thus for example, where sandy or soft ground conditions are encountered the lower ends of the legs or "feet" of a stool or seat may penetrate the ground making it difficult to attain adequate ground support to provide a comfortable stable seating position. The present invention is concerned with the foresaid problems.

Accordingly, it is the general aim of the present invention to provide a seat or stool having at least three legs and increased load carrying capacity as compared to conventional seats and stools of generally like kind. It is a further aim of the present invention to provide improved stools or seats of the foredescribed general type which afford increased ground support to enable stable comfortable seating on soft or sandy ground. In conjunction with the aforesaid objective, it is yet another aim of the invention to provide an improved seat which has a pocket or container for small articles and which may be rapidly collapsed to a portable condition or deployed in a setup condition.

SUMMARY OF THE INVENTION

In accordance with the present invention, a collapsible seat or stool comprises at least three axially elongated legs having upper and lower ends and connected together intermediate the ends for mutual pivotal movement between a folded position wherein the legs are disposed in generally adjacent axially parallel relation to each other and a setup position wherein the legs are disposed in crossing relation to each other and the leg upper and lower ends, respectively, define geometrically shaped seating and supporting planes. A flexible seat member mounted on the leg upper ends is folded to a collapsed position when the legs are in collapsed or folded condition and is generally disposed within the seating plane when the legs are in the setup position. At least one flexible panel assembly connects the legs to each other proximate the lower ends thereof and may be constructed and arranged to be disposed in tension between adjacent legs and in a plane generally parallel to and spaced upwardly from the supporting plane when the seat is setup and in use to provide lateral reinforcement for the legs and thereby increase the load carrying capacity of the seat and for ground engagement to increase the area of seat ground support so that the seat may be used on soft or sandy ground penetrated by the supporting legs.

DETAILED DESCRIPTION OF PREFERRED EMBODIMENTS

Figure 1:
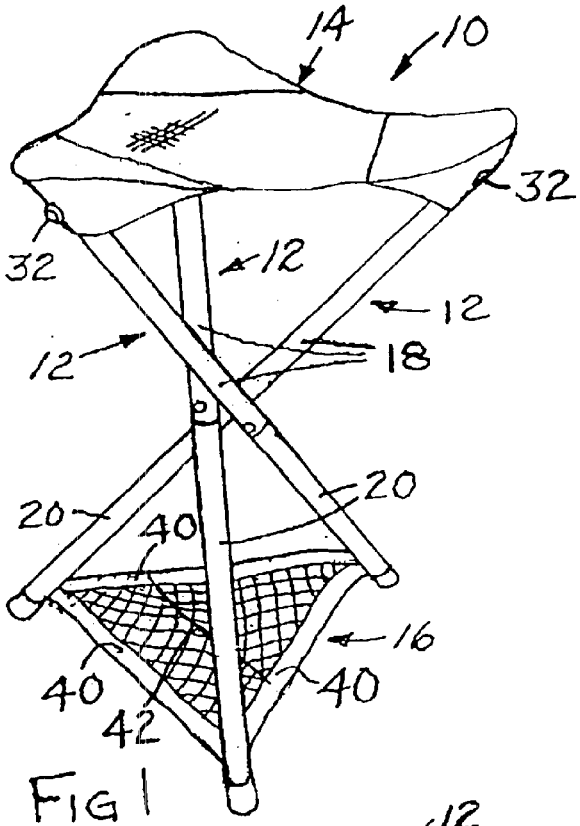
FIG. 1 is a prospective view of a portable collapsible seat embodying the present invention shown in setup condition.

Turing now to the drawings, a portable collapsible seat or stool embodying the present invention is shown in FIG. 1 and designated generally by the reference numeral 10. The illustrated seat 10 essentially comprises at least three axially elongated legs, indicated generally at 12,12, supported for limited mutual pivotal movement between setup and folded or collapsed positions. The stool 10 further includes a flexible seat member, indicated generally at 14, mounted on the upper ends of the legs and maintained in a substantially horizontal seating position by the legs 12,12 when the stool is in setup condition resting on a generally horizontal supporting surface, as it appears in FIG. 1. Further, and in accordance with the present invention, a panel assembly, indicated generally at 16, is connected to and extends between lower end portions of the legs 12,12. The panel assembly 16, may be constructed and arranged to provide substantial lateral reinforcement of the legs 12,12, thereby substantially increasing the load carrying capability of the stool 10. The panel assembly 16 may also serve as an auxiliary base of support for the stool 10 when the stool is supported on soft or sandy ground which is penetrated by the lower ends of the legs 12,12 and/or may be constructed and arranged to provide a pocket for carrying small articles all of which will be hereinafter more fully discussed.

Considering now the illustrated seat 10 in further detail in accordance with presently preferred construction, the legs 12,12 comprise tubular leg assemblies. A typical leg assembly 12 shown in FIG. 2, includes a tubular upper part 18 and a tubular lower part 20 releasably connected in coaxial alignment with each other by a connecting sleeve 22 of reduced diameter slidably received and mounted in fixed position within the lower end of the upper part 18. The sleeve 22 projects for some distance from the lower end of the leg upper part 18 and is adapted to be releasably slidably received within the upper end of a leg lower part 20. An elastomeric cord (bungee cord) 24, generally coaxially supported within the tubular leg assembly formed by the telescopic joiner of the upper and lower parts 18 and 20 biases or urges the two leg parts toward and into and maintains the leg parts in connected assembly. The upper and lower ends of the elastomeric cord 20 pass through central apertures in washers 26,26 sized to seat upon the upper and lower ends of the cylindrically tubular members 18 and 20, respectively. Knots in the upper and lower ends of the cord engage the washers 26,26 and maintain the cord 24 in tension, whereby the upper and lower leg parts are urged toward and into and maintained in connected assembly, as hereinbefore discussed.

Figure 3:
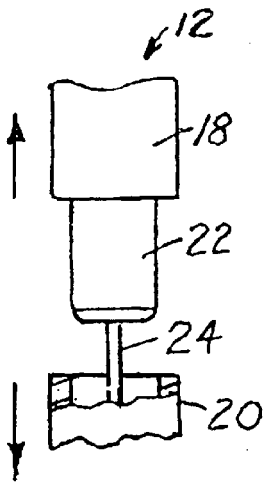
FIG. 3 is a fragmentary side elevational view of a releasable leg-connecting joint shown in separated condition.
Figure 2:
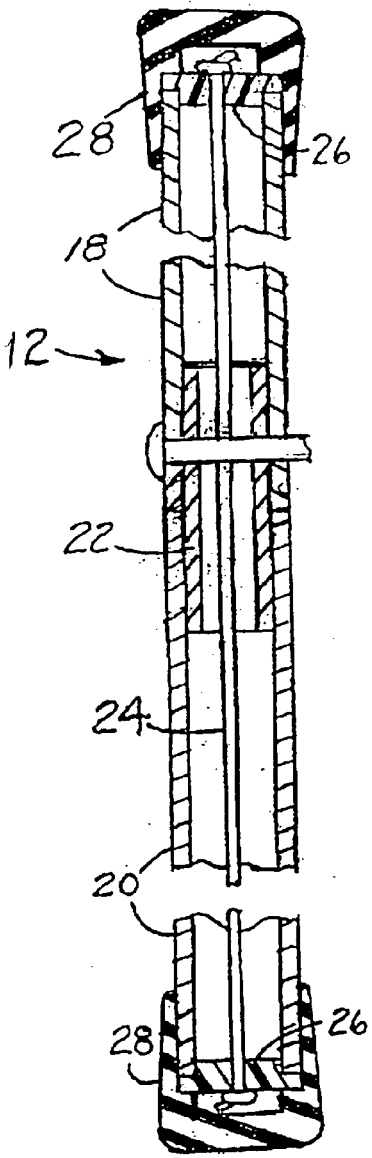
FIG. 2 is a somewhat enlarged fragmentary axial sectional view through a collapsible leg assembly shown in its setup condition.

Resilient end caps 28,28, made from rubber, plastic or other suitable material, grippingly engage both the upper and lower ends of the tubular leg assembly 12 and complete the leg assembly. The resilient end caps 28,28 maintain the washers 26,26 in generally coaxial alignment with the upper and lower end of the tubular parts 18 and 20, as best shown in FIG. 2. In FIG. 3 the leg assembly of FIG. 2 is shown with its axially elongated upper and lower parts 18 and 20 disconnected or separated from each other by application of applied force in axially opposite directions, as indicated by the directional arrows in FIG. 3.

Figure 4:
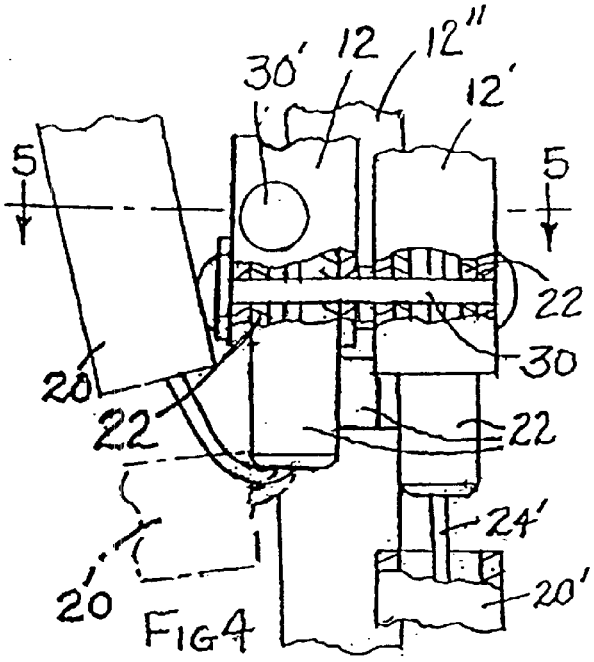
FIG. 4 is a fragmentary side elevation of the leg pivotal connections and shown the upper and lower leg parts in various stages of separation.
Figure 5:
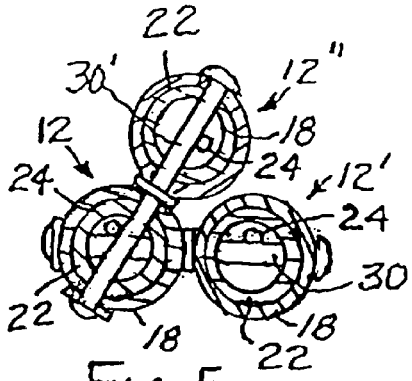
FIG. 5 is a sectional view taken generally along the line 5—5 of FIG. 4.

The three leg assemblies 12,12 which comprise the stool 10 are connected each to another intermediate the upper and lower ends for mutual pivotal movement between folded or collapsed and setup positions, as will be hereinafter further discussed. The leg assemblies 12,12 may be connected together in any suitable manner which permits mutual pivotal movement of the legs relative to each other. However, when the present invention is practiced with separable leg assemblies, as hereinbefore described, the upper parts 18,18 are connected to each other, so that each lower part 20 may be independently separated from its respectively associated upper part 18, for a reason which will be hereinafter further evident. In the illustrated embodiment 10, two pivot fasteners, indicated at 30 and 30', provide pivotal support for the three legs 12, as best shown in FIGS. 4 and 5. Specifically, a first headed pivot pin 30 extends transversally through the upper parts of a first leg 12 and a second leg 12' to provide pivotal connection between the first and second legs. A second pivot pin 30' axially upwardly offset from the first pivot pin 30 provides pivotal connection between the first leg 12 and the third leg, which is indicated at 12". Thus, the upper parts of the three legs 12, 12' and 12" are connected for mutual pivotal movement relative to each other. It should now be noted that the pivot pins 30 and 30' also pass through the sleeves 22,22 associated with the legs supported by the pins. It will now be apparent that the pivot pins 30 and 30' perform dual functions, serving both as pivot pins and as anchors for securing the telescopic joint connecting sleeves 22,22 within the upper parts of the legs 12,12' and 12".

The flexible seat 14 is formed from a triangular sheet of flexible fabric having leather reinforcement patches at its apexes. A downwardly open pocket formed by each reinforcement patch receives the upper end of an associated leg 12 therein. Fasteners 32,32 secure the flexible seat 14 to the upper ends of the legs 12,12 as shown in FIG. 1.

Figure 6:
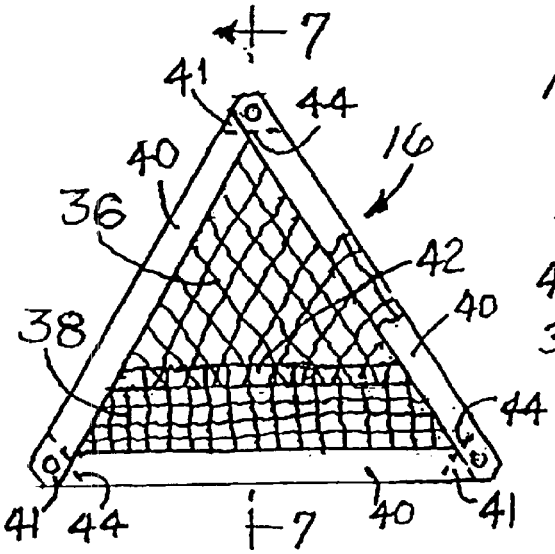
FIG. 6 is a top plan view of the panel assembly of the seat of FIG. 1.
Figure 7:
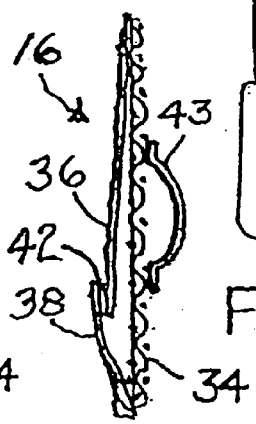
FIG. 7 is a sectional view taken along the line 7—7 of FIG. 6.

Further, and in accordance with the present invention, the panel assembly 16, which includes a plurality of connected panels, is attached to and extends between the leg lower parts 20,20, which define the lower portions of the legs 12,12. It should be noted that the flexible panel assembly has a distinct geometric shape both before and after attachment to the legs 12,12. The illustrated panel assembly 16, best shown in FIGS. 6 and 7 essentially comprises a substantially imperforate bottom panel 34 preferably made from a sheet of woven fabric and having a generally triangular configuration substantially as shown. The assembly 16 further includes a pair of top panels indicated at 36 and 38 formed from perforate material, preferably netting. The panel 36 is generally triangular, but of somewhat smaller size than the bottom panel 34 and overlies and compliments only a portion of the bottom panel 34. The top panel 38 has a generally trapezoidal configuration and compliments another portion of the bottom panel 34. Associated rectilinear edges of the top panels 36 and 38 are arranged in overlapping relation to each other and define a mouth of a pocket formed between the top panels 36 and 38 and the bottom panel 34. The triangular marginal portion of the top and bottom panels are joined together in assembly by elongated narrow panels 40,40 formed from a web material. The various panels which comprise the panel assembly 16 are sewn together or otherwise joined along the perimeter of the triangular assembly whereby the webs 40 are joined to the upper and lower panels and to each other and define the perimeter of the panel assembly 16. In the illustrated embodiment a VELCRO fastener assembly indicated at 42 in FIGS. 6 and 7 provides a releasable closure for the mouth of the pocket formed between the upper and lower panels. An optional flexible strap handle 43 may be secured to the bottom panel 34 at a central portion of its lower surface for a purpose hereinafter discussed.

Figure 8:
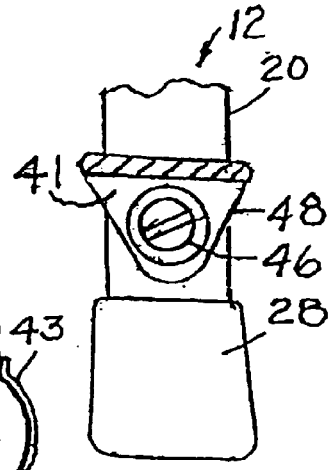
FIG. 8 is a fragmentary elevational view taken along the inner side of a leg and shows the manner in which a panel assembly is attached to an associated leg.

The manner which the panel assembly 16 is attached to the legs of the seat 10 is best illustrated in FIG. 8. The apex portions of the triangular panel assembly 16 are turned downwardly along fold lines 44,44 (FIG. 6) to leg engaging positions. Thereafter, each apex portion, indicated at 41, is secured to the inner surface of an associated leg 12 at a point of connection above the lower end of the leg by a self-tapping fastener 46 which carries a retaining washer 48.

When the seat 10 is in its setup position of FIG. 1 the lower ends of the legs 12,12 are disposed within a common supporting plane and the flexible seat defines a seating surface substantially parallel to the supporting plane. The panel assembly 16 generally defines another plane parallel and in close proximity to but upwardly spaced from the supporting plane defined by the lower ends of the legs 12,12. Thus, when the seat 10 is resting on a firm supporting surface the panel assembly 16 will be generally parallel and in near relation to the supporting surface. When the seat 10 is in use at least the narrow elongated marginal panels 40,40 which extend between the points of connection with the legs 12,12 are in tension and laterally reinforce the legs by resisting lateral or radial splaying movement of the leg lower ends outwardly and away from each other, thereby substantially increasing the load carrying capacity of the stool 10.

If the stool 10 is set up on soft or sandy ground penetrated by the lower ends of the legs 12,12 the bottom surface of panel assembly 16 will engage the ground to increase the area of ground support thereby stabilizing the stool and maintaining the seating surface in a plane substantially parallel to the ground so that the seat 10 may be used where ground conditions are substantially less than ideal, all in addition to providing a convenient pocket for storage of small articles which may, for example, be carried by a hiker, camper or hunter.

To collapse the seat 10 to its portable position the legs 12,12 are first pivoted to a folded or collapsed condition wherein each leg is disposed in generally parallel side-by-side relation to the other of the legs. The reinforced apexes or corners of the triangular seat 14 are somewhat stiffer than the single layer central portion of the seat so that the seat has a tendency to collapse to a desired folded position between the upper ends of the leg upper parts 18,18. After the legs have been folded into generally parallel relation to each other, the seat 10 is further collapsed by separating each leg lower part 20 from its respectively associated upper part 18. The panel assembly 16 now performs a further function serving as a handle for simultaneously separating the lower parts 20,20 from the upper parts 18,18. This operation is performed by holding the upper parts 20,20 while grasping the panel assembly 16 or the optional handle 43 and exerting a pulling force on the panel assembly in a generally axial direction and away from the upper parts 18,18 to effect separation of the lower parts 20 from the connecting sleeves 22,22.

Figure 9:
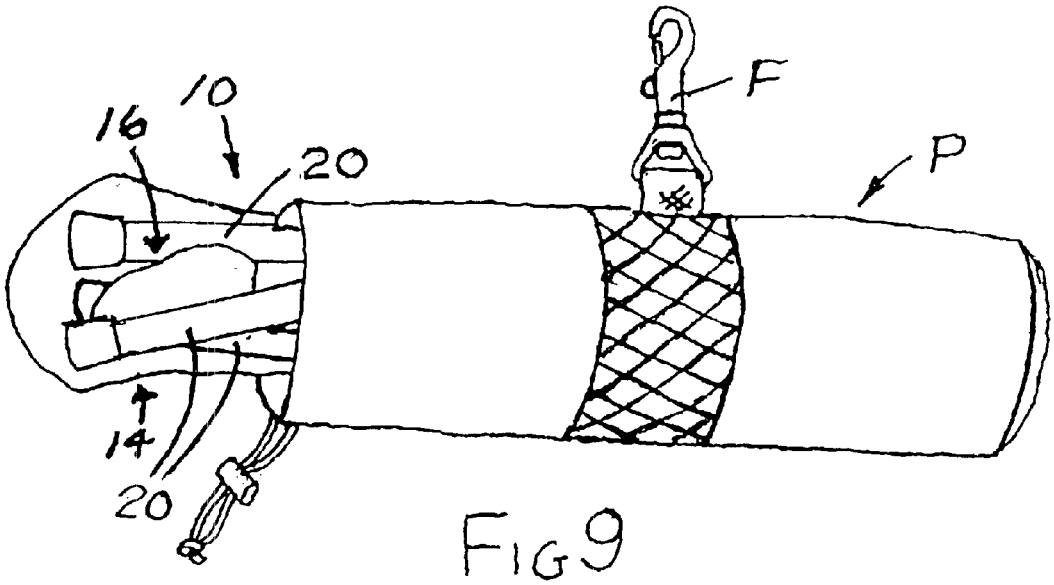
FIG. 9 is a perspective view and shows a collapsed seat embodying the invention in a partial state of insertion into an associated carrying pouch.
Figure 10:
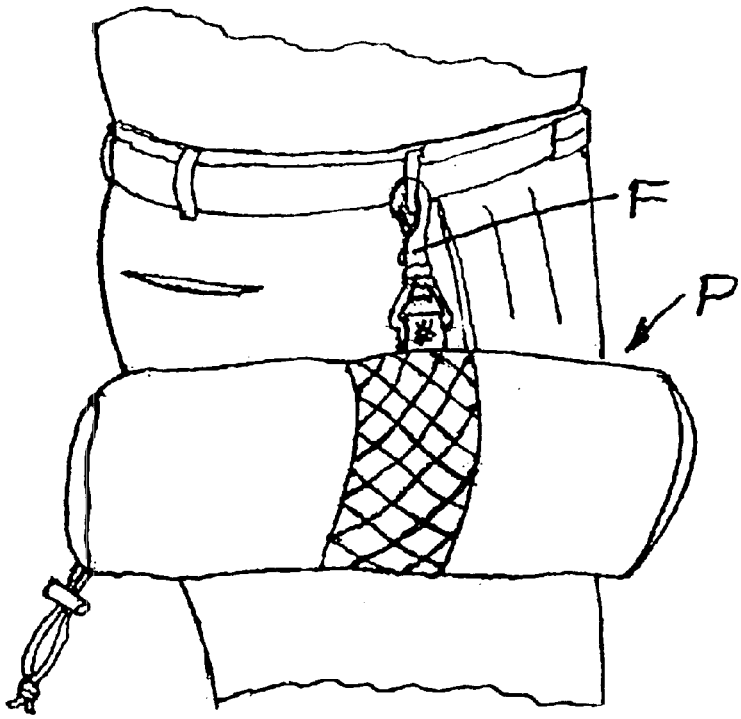
FIG. 10 is a perspective view and shows the pouch of FIG. 9 in a carrying position.

In FIG. 4 the leg lower parts 20,20 are shown in various positions of separation from the upper parts 18,18 for the purpose of illustration. However, it should be understood that leg part separation actually occurs substantially simultaneously. Thereafter, the separated leg lower parts 20,20 are moved upwardly to positions adjacent and generally parallel to the upper parts to complete collapse of the seat to its portable position. The collapsed seat may then be inserted into a carrying pouch such as the pouch indicated generally at P in FIGS. 9 and 10.

The elongated flexible pouch P is open at one end and includes a drawstring closure. The pouch has a carrying member or releasable fastener F attached to it at a central balance point which permits the packaged bundle to be secured to a belt loop or other suitable part of a garment for convenient portage.

When the seat 10 is removed from its pouch and the leg lower parts 20,20 are released. These parts will automatically and simultaneously snap into connected engagement with associated upper parts 18,18, being urged to connected position by the bungee cords 24,24 which are in tension when the seat 10 is in its fully collapsed portable condition. The legs are then spread apart to the setup position shown in FIG. 1 to prepare the seat 10 for use.

In the further description which follows other seats or stools embodying the invention are described which are similar in many respects to the previously described seat 10. Parts of the further embodiments which correspond to parts previously described are identified by the same reference numeral as the previously described parts but include a letter suffix and will not be hereinafter further described in detail.

Figure 11:
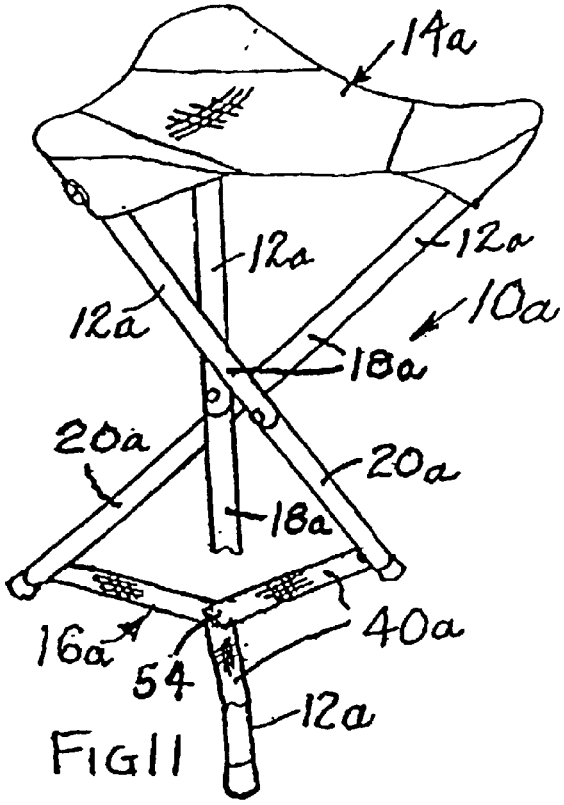
FIG. 11 is similar to FIG. 1 but shows another seat embodying the invention and having another type of panel assembly.
Figure 12:
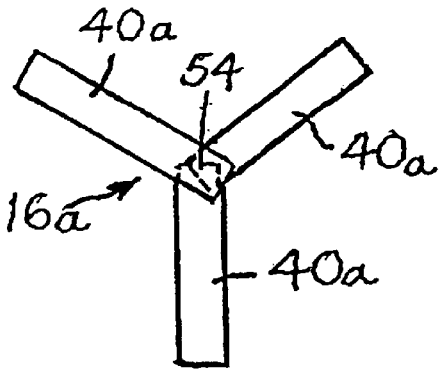
FIG. 12 is a top plan view of the panel assembly shown in FIG. 11.

Considering now FIG. 11, another stool embodying the present invention is illustrated and indicated generally by the reference numeral 10*a*. The seat or stool 10*a* is substantially identical in many respects to the seat 10, but differs therefrom in the construction and the arrangement of its panel assembly, indicated generally by the reference numeral 16*a*. The panel assembly 16*a* is formed by a plurality of narrow elongated connecting panels 40*a*,40*a* of substantially uniform thickness, equal in number to the number of legs 12*a*,12*a*, and are connected to each other in overlapping relation at and radiating from a panel central region 54. The panel assembly 16*a*, further illustrated in FIG. 12, has a generally Y shaped configuration both before and after assembly. The web material utilized to form the connecting panels 40*a*,40*a* is chosen for its load bearing characteristics, particularly in tension. The panel assembly 16*a* has a geometric configuration resembling a letter Y. The free end of each connecting panel 40*a* is connected to the inner surface of an associated leg 12*a* near the lower end of the leg and in the manner generally illustrated in FIG. 8. Each connecting panel 40*a* has a generally horizontal width dimension at least substantially equal to the outside diameter of a cylindrical tubular leg 12*a* to which it is connected. The panel assembly 16*a* is attached to the legs 12*a*,12*a* proximate the lower ends of the legs and is sized to be in tension when the seat 10*a* is in use, whereby to restrain the lower ends of the legs against radial outward splaying movement relative to the panel central region 54. The panel assembly 16*a* is normally maintained in a plane parallel to and upwardly spaced from a supporting plane defined by the lower ends of the legs whereby the panel assembly 16*a* is disposed above and in near spaced relation to the plane of the supporting surface when the seat 10*a* is resting on a substantially firm horizontal supporting surface. The panel assembly 16*a* functions as a ground engaging support member and provides increased load distribution when the seat 10*a* is positioned on soft or sandy ground penetrated by the lower ends of the legs 12*a*,12*a*. It will also be apparent that the panel assembly 16*a* may be employed as a handle to effect simultaneous removal of the leg lower parts 20*a*,20*a* from respectively associated leg upper parts 18*a*,18*a* to facilitate rapid simultaneous collapse of the legs when the seat 10*a* is collapsed for convenient portability.

Where the prime considerations are to increase the load carrying capacity of a seat such as the seat 10*a* and provide for rapid simultaneous disengagement of the leg lower parts from respectively associated upper parts, a panel assembly having a Y shaped configuration such as illustrated in FIG. 11 may be advantageously employed, because the panel central region of connection 54 serves as a convenient central portion where the panel assembly may be gripped to facilitate the application of uniform separating force to the leg lower parts 20*b*,20*b*.

Figure 13:
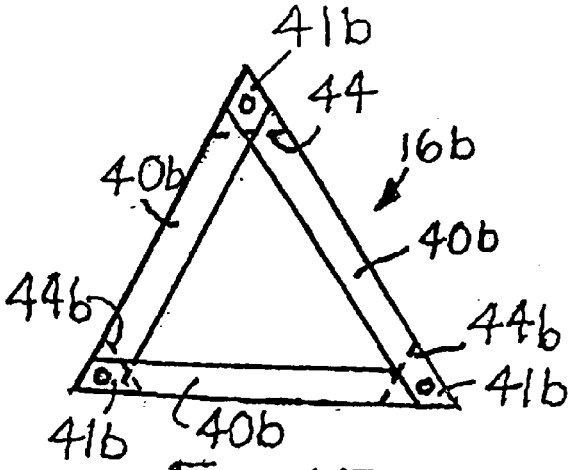
FIG. 13 is a top plan view of another panel assembly which may be used in practicing the invention.

In FIG. 13 there is shown another panel assembly indicated generally by the reference numeral 16*b*. The panel assembly 16*b* is formed by three substantially identical elongated narrow panels 40*b*,40*b* of substantially uniform thickness formed from web material and joined to each other at apex portions 41*b*,41*b*. The panel assembly 16*b* is similar in some respects to the panel assembly 16, shown in FIGS. 6 and 7. However, the panel assembly 16*b* is formed entirely by the three panels 40*b*,40*b* and has a generally triangular configuration. The connected apex portions 41*b*,41*b* are folded downwardly along fold lines 44*b*,44*b* for attachment to the inner surfaces of the legs of an associated stool or seat similar to the seat 10*a* shown in FIG. 11.

Figure 14:
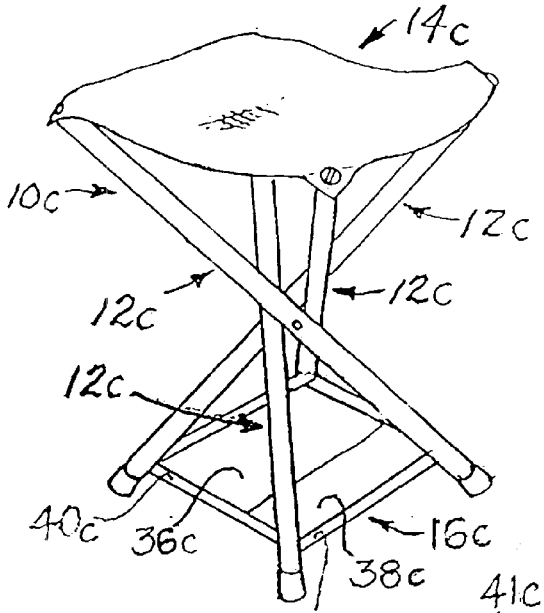
FIG. 14 is similar to FIG. 1 but shows still another portable collapsible seat having yet another type of panel assembly.

It should be understood that the present invention may also be practiced with portable collapsible seats having more than three legs and in FIGS. 14–16 the invention is further illustrated and described with reference to a seat 10*c* which has four axially elongated unitary legs which carry a flexible seat indicated generally at 14*c*. The legs, indicated generally at 12*c*,12*c*, are connected intermediate upper and lower ends by a single central connecting member of a type well known in the art. The central connecting member (not shown) supports the legs for mutual pivotal movement relative to each other between a folded position wherein the legs are disposed in generally parallel side-by-side relation to each other a setup position wherein the legs are spread apart at upper and lower ends and cross each other intermediate the ends. As in the previously described embodiments, the flexible seat member 14*c* is mounted on the upper ends of the legs. However, the flexible seat member 14*c* differs from those previously described in that the polygonal configuration of the seat member is rectangular and more specifically generally square.

In accordance with the invention, the seat 10*c* also has a panel assembly 16*c* connected to each of the legs in the manner hereinbefore described and shown in FIG. 8. The geometric configuration of the panel assembly 16*c* is generally determined by the points of connection to the legs, which generally define a square. Further, since the seat 10*c* has four legs which define a generally square foot print on a supporting surface in setup position, the configuration of the panel assembly 16*c* is also generally square.

Figure 15:
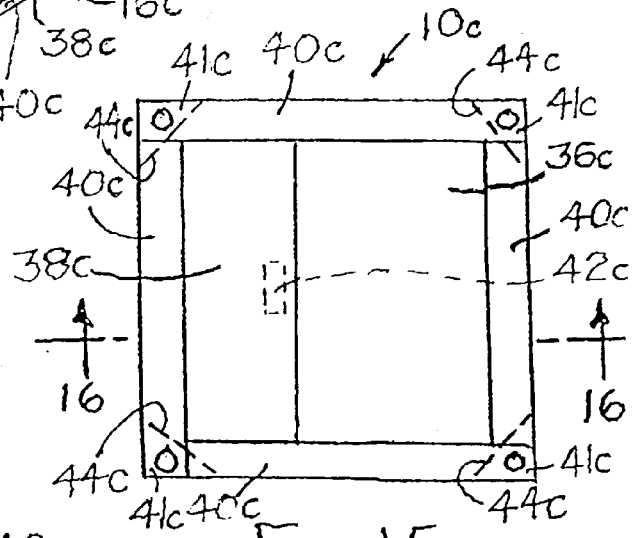
FIG. 15 is a top plan view of the panel assembly of FIG. 14.
Figure 16:
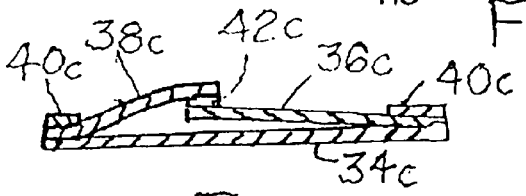
FIG. 16 is a sectional view taken along the line 16—16 of FIG. 15.

Considering now the panel assembly 16*c* in further detail and referring particularly to FIGS. 15 and 16, the illustrated panel assembly has a substantially square bottom panel 34*c* and two top panels of rectangular configuration 36*c* and 38*c*, one being substantially larger than the other. The top panels are arranged to compliment associated portions of the bottom panel. Marginal edges of the top panels disposed in overlapping relation to each other define a mouth of a pocket formed between the top and bottom panels. As in the previously described embodiment 10 a VELCRO fastener assembly 42*c* carried by the overlapping portions of the top panels form a closure for the pocket. Four elongated narrow panels 42*c*,42*c* of substantially uniform thickness extend along the marginal portions of the structure to complete the panel assembly. These narrow flexible panels impart additional strength to the panel assembly 16*c* in the regions between the points of connection to adjacent legs to provide lateral reinforcement of the legs, which substantially increases the load carrying capacity of the seat 10*c*. All of the panels which comprise the assembly are formed from flexible substantially imperforate materials. The panel assembly 16*c* is preferably connected to the legs near the lower ends thereof and serves as a ground engaging member to stabilize the seat or stool 10*c* and further support it when it is used on soft or sandy ground which is penetrated by the lower ends of the legs.

What is claimed is:

1. A portable collapsible seat comprising; at least three legs having upper and lower portions including upper and lower ends, all of said legs being connected together intermediate said ends in a generally central region of said seat for pivotal movement between a setup position wherein said upper portions are upwardly and radially outwardly inclined from said central region and said lower portions are downwardly and radially outwardly inclined from said central region and said lower ends define a common plane and a collapsed position wherein said legs are disposed in generally parallel side-by-side relation to each other, a flexible seat mounted on said upper ends and defining a generally horizontal disposed seating surface generally parallel to said common plane, and a ground engaging flexible panel assembly having a lower surface and including a plurality of connected panels attached to and extending between said lower end portions and disposed within another plane generally parallel to said seating surface and said common plane and spaced above said common plane and below said central region for restraining said lower portions against generally radially outward splaying movement from said setup position to increase the carrying capacity of said seat and for increasing the area of ground support for said seat when said seat is in said setup position on soft ground and said lower ends penetrate the soft ground a sufficient distance to cause said panel assembly to engage the soft ground.

2. A portable collapsible seat as set forth in claim 1 wherein said panel assembly includes a plurality of connected narrow elongated connecting panels formed from web material, equal in number to said legs, and defining the perimeter of said panel assembly.

3. A portable collapsible seat as set forth in claim 2 wherein said legs are cylindrical and the width dimension of said connecting panels is at least equal to the diameter of said legs.

4. A portable collapsible seat as set forth in claim 2 wherein said panel assembly includes a substantially imperforate bottom panel and said connecting panels are joined to marginal portions of said bottom panel.

5. A portable collapsible seat as set forth in claim 4 wherein said bottom panel has a lower surface and said panel assembly includes a handle secured to a central portion of said lower surface.

6. A portable collapsible seat as set forth in claim 1 wherein said panel assembly includes a substantially imperforate bottom panel and a top panel overlaying said bottom panel and cooperating with said bottom panel to form a horizontally disposed upwardly opening pocket therebetween.

7. A portable collapsible seat as set forth in claim 6 wherein said top panel is formed from perforate material.

8. A portable collapsible seat as set forth in claim 7 wherein said perforate material is a netting.

9. A portable collapsible seat as set forth in claim 1 wherein said panel assembly has a perimeter having a distinct geometric shape both before and after attachment to said legs.

10. A portable collapsible seat as set forth in claim 9 wherein said geometric shape is substantially triangular.

11. A portable collapsible seat as set forth in claim 9 wherein said geometric shape is substantially rectangular.

12. A portable collapsible seat as set forth in claim 9 wherein said geometric shape is substantially square.

13. A portable collapsible seat as set forth in claim 9 wherein said geometric shape is polygonal.

14. A portable collapsible seat as set forth in claim 1 wherein said panel assembly includes top and bottom panels which cooperate to define a horizontally disposed pocket therebetween.

15. A portable collapsible seat as set forth in claim 14 wherein said top panels are formed from perforate material.

16. A portable collapsible seat as set forth in claim 15 wherein said perforate material is a netting.

17. A portable collapsible seat as set forth in claim 1 wherein said legs are tubular legs and said lower portions are telescopically connected to said upper portions in said setup position.

18. A portable collapsible seat as set forth in claim 1 wherein said legs comprise tubular legs having separable upper and lower parts joined by telescopic connections and contain elastomeric cords normally biasing said parts into connected engagement and said panel assembly is connected to each of said lower parts and functions as a handle for substantially simultaneously separating said lower parts from said upper parts.

19. A portable collapsible seat as set forth in claim 18 wherein said panel assembly includes top and bottom panels defining a horizontally disposed upwardly opening pocket therebetween when said seat is in said setup position.

20. A portable collapsible seat as set forth in claim 18 wherein said telescopic connections include sleeves carried by said upper parts and received within said lower parts and said legs are connected each to another by pivot pins carried by said upper parts and anchoring said sleeves to said upper parts for separation of said sleeves from said lower parts.

21. A portable collapsible seat comprising; at least three axially elongated legs, each of said legs having upper and lower portions including upper and lower ends, said legs connected each to another intermediate said upper and lower ends for pivotal movement between collapsed and setup positions, said legs in said collapsed condition being disposed in generally parallel side-by-side relation to each other, said legs in said setup position crossing each other with said lower ends in a common generally horizontal supporting plane, a flexible seat mounted on said upper ends and defining a horizontal seating surface substantially parallel to said supporting plane when said seat is resting on a generally horizontal supporting surface and said legs are in said setup position, and a flexible panel assembly including a plurality of connected panels attached to each of said legs and extending between said lower portions of said legs, said panel assembly including top and bottom panels defining a horizontally disposed pocket therebetween accessible from the upper side of said panel assembly.

22. A portable collapsible seat comprising; at least three axially elongated tubular legs having upper and lower ends respectively defined by separable upper and lower parts, sleeves received within and projecting from said upper parts for reception in said lower parts to connect said lower parts in telescopic engagement within said upper parts, elastomeric cords disposed within said legs for biasing said upper and lower part axially toward each other and into telescopically connected engagement, a plurality of pivot pins securing said sleeves to said upper parts and connecting said legs each to another for mutual pivotal movement relative to each other between a partially collapsed position wherein said legs are disposed in generally parallel side-by-side relation to each other and a setup position wherein said legs are in crossing relation to each other and said lower ends define a common supporting plane, said seat having a fully collapsed condition wherein said lower parts are separated from said upper parts and disposed in generally parallel side-by-side relation to said upper parts, a seat formed from a flexible sheet, and a panel assembly connected to each of said lower parts in spaced relation to said lower ends to function as a handle for substantially simultaneously separating said lower parts from said upper parts.

23. A portable collapsible seat as set forth in claim 22 wherein said panel assembly has a Y shaped configuration.

* * * * *